US006202615B1

(12) United States Patent
Pels et al.

(10) Patent No.: US 6,202,615 B1
(45) Date of Patent: Mar. 20, 2001

(54) METHODS AND APPARATUS FOR STARTING AN INTERNAL COMBUSTION ENGINE

(75) Inventors: Thomas Pels, Achern; Klaus Revermann, Schwerinsdorf; Holger Riekenbrauck; Klaus-Peter Zeyen, both of Köln, all of (DE)

(73) Assignee: ISAD Electronic Systems, GmbH & Co., KG, Cologne (DE)

( * ) Notice: Subject to any disclaimer, the term of this patent is extended or adjusted under 35 U.S.C. 154(b) by 0 days.

(21) Appl. No.: 09/389,992

(22) Filed: Sep. 3, 1999

Related U.S. Application Data

(63) Continuation of application No. PCT/EP98/01297, filed on Mar. 6, 1998.

(30) Foreign Application Priority Data

Mar. 6, 1997 (DE) ..... 197 09 298

(51) Int. Cl.[7] ..... F02N 11/08; F02N 17/00

(52) U.S. Cl. ..... 123/179.3; 123/179.21; 290/38 R; 307/10.6

(58) Field of Search ..... 123/179.21, 179.3; 290/38 R; 307/10.1, 10.6, 10.7, 48; 320/126, 104

(56) References Cited

U.S. PATENT DOCUMENTS

| | | | | |
|---|---|---|---|---|
| 3,463,995 | | 8/1969 | Herold | 320/6 |
| 5,041,776 | | 8/1991 | Shirata et al. | 320/1 |
| 5,050,545 | | 9/1991 | Shirata et al. | 123/179 |
| 5,146,095 | * | 9/1992 | Tsuchiya et al. | 290/38 R |
| 5,175,439 | | 12/1992 | Härer et al. | 307/10.1 |
| 5,207,194 | | 5/1993 | Clerici | 123/179.1 |
| 5,260,637 | * | 11/1993 | Pizzi | 320/6 |
| 5,525,891 | | 6/1996 | Meyer et al. | 320/15 |
| 5,635,771 | | 6/1997 | Mertl et al. | 307/10.7 |

FOREIGN PATENT DOCUMENTS

| | | |
|---|---|---|
| 37 13 835 A1 | 11/1988 | (DE) . |
| 37 43 317 A1 | 6/1989 | (DE) . |

(List continued on next page.)

OTHER PUBLICATIONS

VDI—Berichte Nr. 1165, 1994, pp. 201–215, R. Knorr and B. Willer "Neue Kondensatoren für die Energiespeicherung" (German with Abstract).

*International Search Report* concerning International Application Serial No. PCT/EP98/01297, European Patent Office, dated Jul. 14, 1998, 6 pages.

*Primary Examiner*—Tony M. Argenbright
*Assistant Examiner*—Arnold Castro
(74) *Attorney, Agent, or Firm*—Marshall, O'Toole, Gerstein, Murray & Borun

(57) ABSTRACT

Methods and apparatus for starting an internal combustion engine are disclosed. One of the disclosed apparatus includes an electric starter operatively coupled to the internal combustion engine and an energy storage device for supplying the starter with power. The apparatus is also provided with a sensor for detecting a temperature of the internal combustion engine and a consumer control device associated with a consumer of electrical power. The apparatus is further provided with a power flow controller which controls the consumer control device such that a portion of the energy stored in the energy storage device is delivered to the consumer of electrical power before the electric starter is supplied with power. The portion of the energy has a size which is dependent upon the sensed temperature. The size of the portion is smaller at low temperatures than at high temperatures. In some embodiments, the power flow controller uses the sensed temperature to supplement the energy drawn from the short-term accumulator with energy from the long-term accumulator to ensure the starter is provided with sufficient energy to start the internal combustion engine.

29 Claims, 5 Drawing Sheets

FOREIGN PATENT DOCUMENTS

| | | | |
|---|---|---|---|
| 37 43 317 C2 | | 9/1989 | (DE) . |
| 40 28 242 A1 | | 3/1992 | (DE) . |
| 41 35 025 A1 | | 4/1992 | (DE) . |
| 44 22 256 A1 | | 1/1996 | (DE) . |
| 195 41 001 | | 2/1997 | (DE) . |
| 195 32 163 A1 | | 3/1997 | (DE) . |
| 0 390 398 A1 | | 10/1990 | (EP) . |
| 0 403 051 A1 | | 12/1990 | (EP) . |
| 0 420 379 B1 | | 4/1991 | (EP) . |
| 0 533 037 B1 | | 3/1993 | (EP) . |
| 0 688 698 A2 | | 12/1995 | (EP) . |
| 02 175 350 | | 7/1990 | (JP) . |
| 02 175 351 | | 7/1990 | (JP) . |
| 405202834 | * | 8/1993 | (JP) . |
| 07 305 672 | | 11/1995 | (JP) . |
| 408158995 | * | 6/1996 | (JP) . |
| 126 5388 A1 | | 10/1986 | (RU) . |
| WO 93/11003 | | 6/1993 | (WO) . |
| WO 97/08439 | | 3/1997 | (WO) . |

* cited by examiner

METHODS AND APPARATUS FOR STARTING AN INTERNAL COMBUSTION ENGINE

RELATED APPLICATION

This is a continuation of patent application Ser. No. PCT/EP98/01297 filed Mar. 6, 1998.

FIELD OF THE INVENTION

The invention relates generally to internal combustion engines, and, more particularly, to methods and apparatus for starting an internal combustion engine.

BACKGROUND OF THE INVENTION

It is known that an internal combustion engine can be started with energy stored in one or more capacitors. In such arrangements, the energy required for starting is supplied to the capacitor from a vehicle battery (with 12 volts or 24 volts). The energy from the battery is brought to a higher voltage level by means of a high-positioning DC/DC converter and stored in the capacitor(s). Such starter systems are known, for example, from SU 1,265,388 A1 (MOSC AUTOMECH), as well as from EP 0 390 398 A1 (ISUZU).

In simpler systems, the capacitor(s) lie at the same voltage level as the vehicle battery, (i.e., no high positioner is connected between the capacitor(s) and the battery). Examples of such simpler systems are offered by DE 41 35 025 A1 (MAGNETI MARELLI), and U.S. Pat. No. 5,041, 776 (ISUZU). In all of the aforementioned systems, the battery is separated from the starter motor during the starting process. All of the energy used for starting is, therefore, drawn from the capacitor accumulator(s).

JP 02175350 A (ISUZU) and JP 02175351 A (ISUZU) describe simple systems of the second-named type (i.e., the simple systems that do not include a voltage converter). However, in these disclosures, the battery and the pre-charged capacitor are connected in parallel during the starting process, so that both energy storage devices (i.e., accumulators) contribute to the starting process.

It is also known from EP 0 403 051 A1 (ISUZU) that a capacitor used to store starting energy can be charged only up to a certain variable voltage level. This maximum voltage level depends on the temperature of the engine coolant.

In addition to the above proposals which concern the use of capacitors as accumulators for storing and supplying starting energy to an electric starter, there are also proposals for using capacitors for other applications, (for example, as accumulators for storing energy required for electrical heating). EP 0 533 037 B1 (MAGNETI MARELLI) discloses electrical catalyst heating and EP 0 420 379 B1 discloses an electrical glow unit for a diesel engine, in which the heating energy is kept ready in a capacitor.

Finally, electrical systems with a starter battery and a vehicle battery are known from WO93/11003 (BOSCH) and EP 0 688 698 A2 (BMW et al.). In these arrangements, the starter battery and vehicle battery are charged together, but are separated during the stating process. In the last-named publication, the two batteries are connected via a control unit that controls the charging process.

Known starter systems employing capacitors guarantee reliable starting, even under very cold conditions. They also permit smaller layout of the ordinary vehicle battery, which, in itself, is less suited for short-term discharging during starting.

SUMMARY OF THE INVENTION

In accordance with an aspect of the invention, an apparatus is provided for use with an internal combustion engine and a consumer of electrical power. The apparatus includes an electric starter operatively coupled to the internal combustion engine. It also includes a short-term energy storage device in circuit with the starter. The short-term energy storage device stores energy for supplying the starter with power. The apparatus is also provided with a sensor for detecting a temperature of the internal combustion engine. The apparatus is further provided with a power flow controller in communication with the sensor. The power flow controller controls power flow from the energy storage device to the consumer such that a portion of the energy stored in the short-term energy storage device is delivered to the consumer of electrical power before the electric starter is supplied with power. The portion of the energy has a size which is dependent upon the sensed temperature. The size of the portion is smaller at low temperatures than at high temperatures.

In accordance with another aspect of the invention, an apparatus is provided for use with an internal combustion engine. The apparatus includes an electric starter operatively coupled to the internal combustion engine, and a short-term energy storage device in circuit with the starter. The short-term energy storage device stores energy for supplying the starter with power. The apparatus is further provided with a long-term energy storage device, a sensor for detecting a temperature of the internal combustion engine, and a coupling circuit separating the short-term energy storage device from the long-term energy storage device. The coupling circuit is arranged to permit simultaneous withdrawal of energy from the short-term energy storage device and the long-term energy storage device for delivery to the electric starter during a starting operation. The apparatus also includes a power flow controller in communication with the sensor and the coupling circuit to actively control an amount of energy withdrawn from at least one of the short-term energy storage device and the long-term energy storage device based on the sensed temperature to ensure sufficient energy is supplied to the electric starter to start the internal combustion engine.

In accordance with still another aspect of the invention, a method is provided for starting an internal combustion engine. The method comprises the steps of: charging a short-term energy storage device; measuring a temperature; and determining a first amount of energy required to start the internal combustion engine at the measured temperature. The method also includes the steps of: determining if the short-term energy device contains more than the first amount of energy; and, if so, responding to a command to start the internal combustion engine by delivering a second amount of energy from the short-term energy storage device to at least one consumer of electrical power. The method also includes the step of starting the internal combustion engine using the energy remaining in the short-term energy storage device.

In accordance with yet another aspect of the invention, a method is provided for starting an internal combustion engine. The method includes the steps of: charging a short-term energy storage device; measuring a temperature; and determining a first amount of energy required to start the internal combustion engine at the measured temperature. The method also includes the step of delivering the first amount of energy to an electric starter by: (a) simultaneously withdrawing a second amount of energy from the short-term energy storage device and a third amount of energy from the long-term energy storage device; and (b) actively controlling the size of at least one of the first and second amounts of energy based on the sensed temperature to ensure that the electric starter is supplied sufficient energy to start the internal combustion engine.

Other features and advantages are inherent in the disclosed apparatus and methods or will become apparent to those skilled in the art from the following detailed description and its accompanying drawings.

DESCRIPTION OF THE PREFERRED EMBODIMENTS

Figure 3:
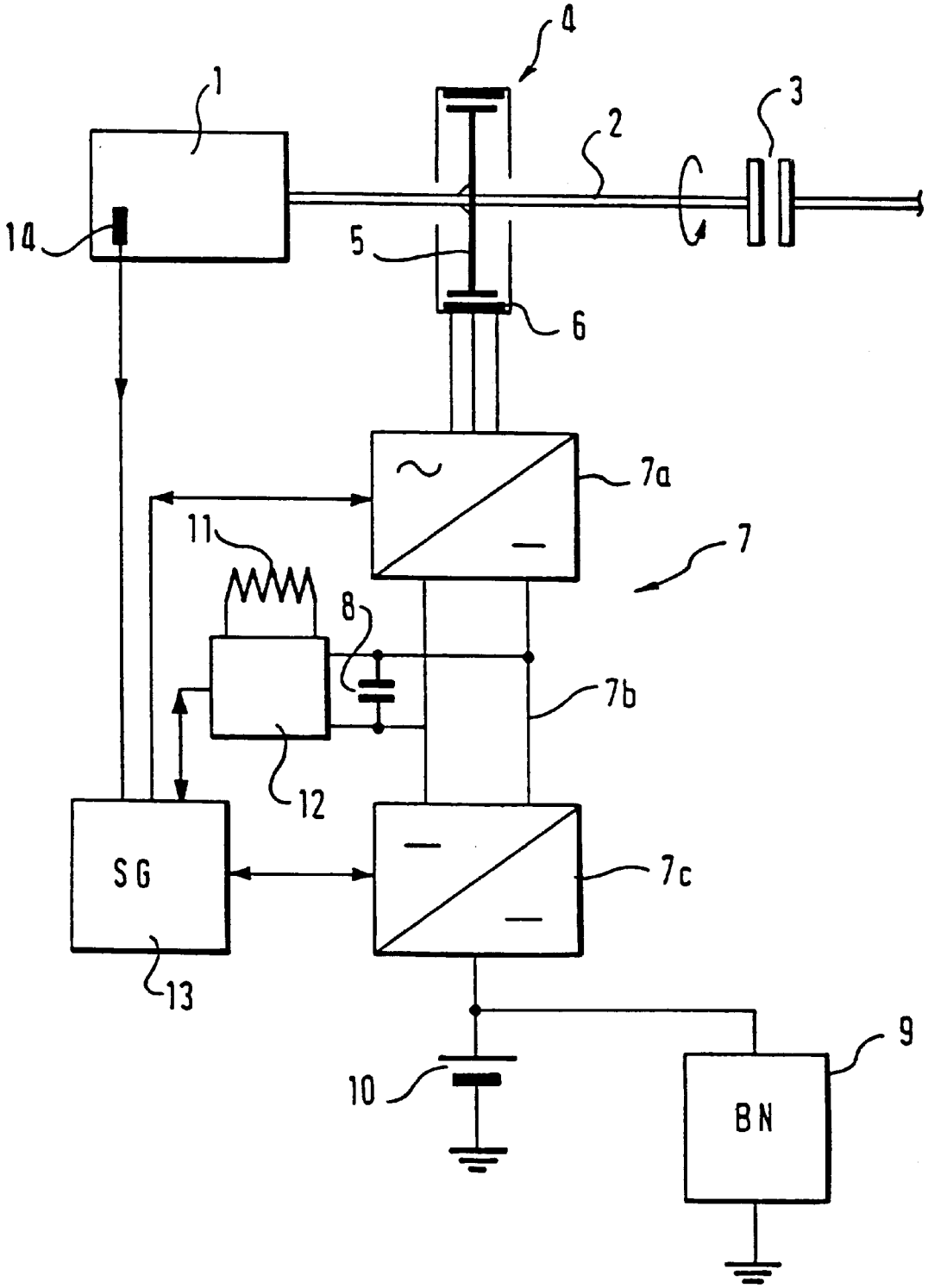
FIG. 3 is a schematic illustration of an apparatus constructed in accordance with the teachings of the invention operating in an exemplary environment of use.

An apparatus constructed in accordance with the teachings of the invention is shown in FIG. 3 in a preferred environment of use, namely, in an internal combustion engine 1 of a vehicle such as a passenger car. As discussed more fully below, the disclosed apparatus employs a short-term energy storage device 8 as a repository of energy to be used in starting the serviced internal combustion engine 1. Before proceeding further with the discussion, however, a few terms will be defined.

As used herein, the terms "short-term accumulator" and "short-term energy storage device" are understood to mean any energy storage device for electrical energy which, when fully charged, can discharge the greatest part (for example, 97%) of the energy it stores without disturbance within 60 seconds. Preferably, the short-term energy storage devices can actually discharge this portion of energy within 30 seconds, and even more preferably, within 15 seconds of receipt of a command to discharge. While in the disclosed apparatus, the short-term accumulator is implemented by one or more capacitors, persons of ordinary skill in the art will appreciate that chemical energy accumulators (e.g., batteries) can also be used in this role without departing from the scope or spirit of the invention. For example, so-called alkaline secondary systems such as alkline nickel/cadmium systems or nickel/iron systems, which can contain sinter electrodes or fiber structure electrodes can be used in this role.

As used herein, the terms "long-term accumulator" and "long-term energy storage device" mean an energy storage device which, when fully charged, can only discharge the greater part of its energy in periods of approximately 10 minutes or more.

As more fully described below, there are two primary aspects of the invention. Each of these primary aspects are discussed in turn below.

The following findings underlie the first aspect of the invention. At low temperatures of the internal combustion engine 1, (especially in severe frost like −20° C.), the electrical energy required for starting the engine 1 is much greater than at high temperatures, (e.g., at the operating temperature of the engine 1). This increased starting reluctance is primarily due to the much greater resistance that the internal combustion engine 1 imposes on starter rotation, owing to the greater viscosity of the oil when cold. To ensure starting under all expected conditions, the starter system must be designed for the lowest temperatures that occur in practice. This means that the capacitance of the capacitor(s) implementing the short-term energy storage device is strongly over-dimensioned for the generally higher temperatures that occur under typical operating conditions. This is particularly true for embodiments in which the capacitor(s) store all of the energy required for starting. However, it is also true, although to a somewhat lesser degree, for those embodiments in which part of the starting energy is taken from a long-term energy storage device such as the vehicle battery and only part of the starting energy is stored by the short-term energy storage device.

In order to avoid charging the capacitor(s) with more energy than is required to start the engine at the commonly occurring higher temperatures, the aforementioned EP 0 403 051 A1 (ISUZU) proposes storing smaller amounts of energy in the capacitor with increasing temperature. However, even if temperature dependent charging of the short-term accumulator is employed as suggested by the ISUZU reference, the short-term energy storage device must still be dimensioned for the lowest occurring temperature and, therefore, it is still over-dimensioned in most operating temperatures.

In accordance with the first aspect of the invention, it has been recognized that the fraction of the energy stored in the short-term energy storage device which is not required for starting the engine at higher temperatures can be supplied to consumers other than the starter at such higher temperatures in order to briefly supply those other customers with higher power, preferably before starting the internal combustion engine 1. At high temperatures like the typical operating temperature of the engine 1, a relatively large amount of energy and power is available to these additional consumers before starting. As the temperature of the internal combustion engine 1 decreases, the energy available to the additional consumer diminishes, since a greater amount of energy must be retained for the starting process. With appropriate dimensioning of the capacitor, preferably no energy is left for the additional consumers at the lowest occurring temperature. Their supply, in this relatively rare case, can be shifted to the time immediately after starting, if a generator driven by the internal combustion engine 1 delivers sufficient power for such supply.

Figure 1:
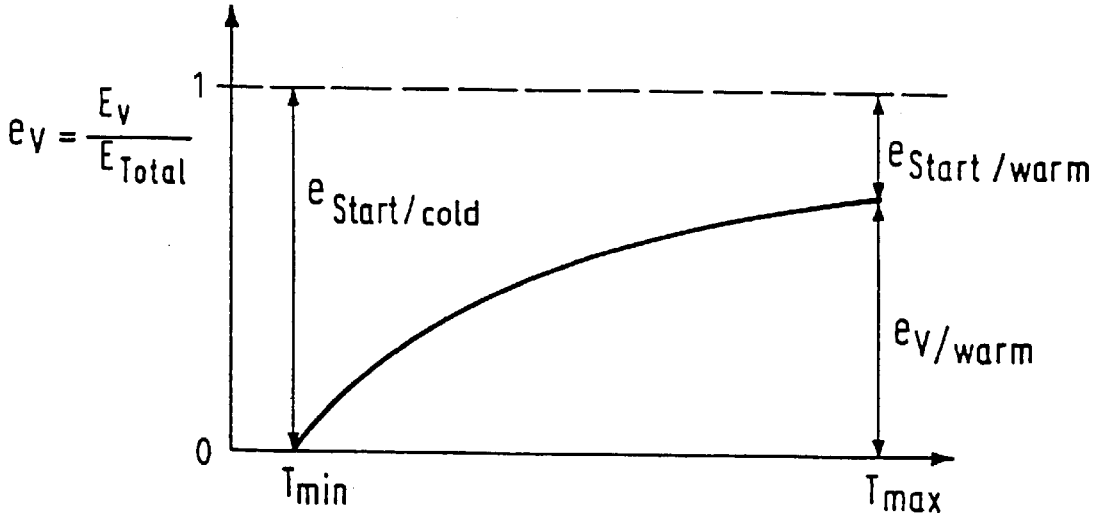
FIG. 1 is a diagram showing a curve representing the relative amount of energy available for supplying a consumer (other than the starter) as a function of temperature in an exemplary short-term accumulator.

FIG. 1 illustrates the energy ratios as a function of temperature for an exemplary short-term accumulator (in this example, a capacitor). The percentage $e_v$ of energy stored in the capacitor that can be diverted to the consumers other than the starter is plotted as a function of the temperature of the internal combustion engine 1. The percentage $e_v$ is defined as the ratio of the amount of energy $E_v$ delivered to the consumer(s) and the amount of total energy $E_{total}$ stored in the capacitor. Conversely, the ratio of the energy required to start the engine 1 versus the amount of energy stored in the capacitor is defined as the starting energy fraction $e_{start/cold}$. In FIG. 1, it is assumed that all of the staring energy is supplied by the capacitor. Therefore, at the one extreme value, (i.e., the lowest occurring temperature $T_{min}$), the consumer energy fraction $e_v$ equals zero. In this circumstance, all of the energy stored in the capacitor is required for starting, (i.e., the starting energy fraction $e_{start/cold}$ is equal to one). At the highest occurring temperature $T_{max}$, (for example, the operating temperature of the internal combustion engine 1), only part of the stored energy is required for starting, (i.e., the starting energy fraction $e_{start/warm}$ is much smaller than one). Therefore, at temperatures above the minimum expected temperature, excess energy is stored in the capacitor and this excess energy can be used to supply a consumer before starting. The consumer energy fraction $e_{v/warm}$ is equal to the difference between one and $e_{start/warm}$. FIG. 1 schematically shows $e_v$ for all values between $T_{min}$ and $T_{max}$. Because the resistance that the internal combustion engine 1 imposes on the starter diminishes with increasing temperature, and because the engine 1 experiences diminishing starting torque with increasing temperature, the $e_v$ curve is monotonically increasing as shown in FIG. 1.

Apparatus constructed in accordance with the second aspect of the invention include short-term energy storage devices which are not dimensioned large enough to store sufficient energy to start the internal combustion engine 1 without assistance at low temperatures. Instead, these apparatus simultaneously withdraw energy from the short-term energy storage device and the long-term energy storage device (for example, an ordinary sulfuric acid lead battery such as the vehicle battery). Simple parallel circuits of a vehicle battery and a capacitor are, as mentioned above, known from Japanese publications 02175350 A (ISUZU) and 02175351 A (ISUZU). However, these circuits are quite simple starter systems. On the other hand, more advanced known systems under development include a voltage converter between the battery and the capacitor which keeps the two accumulators separate from each other during starting (see, for example, SU 1265388 A1 (MOSK AUTOMECH) mentioned in the introduction). The voltage converter serves to charge the capacitor to a higher voltage than the long-term accumulator (e.g., the battery).

Apparatus constructed in accordance with the second aspect of the invention pursue a different path. In particular, such apparatus provide an actively controllable coupling between the long-term and short-term energy storage devices (e.g., battery and capacitor) both during the charging of the short-term energy storage device and when the energy storage devices are discharged during the starting process. The participation of both energy storage devices in the starting process permits smaller dimensioning of the short-term accumulator and simultaneous adjustment of the power demand experienced by each energy storage device to the generally different characteristics of the two different types of energy storage devices. As used wherein, the term "actively controllable" and variants thereof are not limited in meaning to connecting and disconnecting the long-term accumulator and/or short-term accumulator, but instead include continuous adjustment of the ratio of the energy and/or power that is withdrawn from the long-term energy storage device versus the energy and/or power that is withdrawn from the short-term accumulator during starting (or vice versa).

Figure 2:
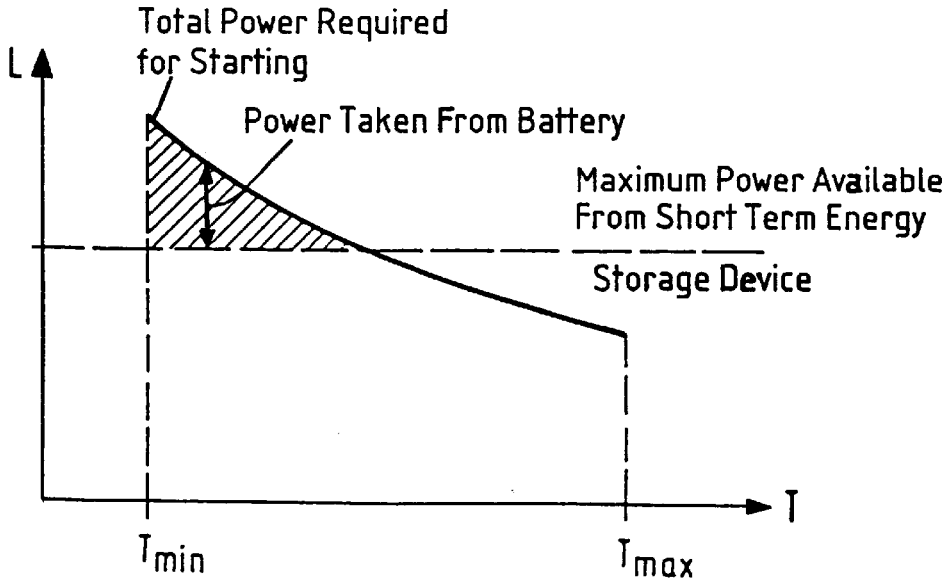
FIG. 2 is a diagram showing a curve representing the total power required for starting an exemplary internal combustion engine and a curve representing the maximum power available from an exemplary short-term accumulator, both as a function of temperature.

FIG. 2 is a graph illustrating a curve representing the total power required (for a specific torque) to start an exemplary engine as a function of temperature. It also shows a curve representing the maximum power available from an exemplary short-term energy storage device which, in accordance with the teachings of the second aspect of the invention, is not dimensioned to provide all of the starting power required at the low end of the expected range of operating temperatures. The latter curve (shown with a dashed line in FIG. 2) is temperature independent and, thus, appears as a horizontal line in FIG. 2. As explained above, the total power required to start the engine is maximum at the lowest occurring temperature $T_{min}$ and diminishes with increasing temperature to the highest occurring temperature $T_{max}$. Since the short-term energy storage device and the battery cooperate during the steting process, the maximum short-term accumulator power preferably lies below the maximum total power at the lowest occurring temperature $T_{min}$ (i.e., forms a sort of base). Energy is only taken from the battery in the temperature range in which the total power curve lies above this base. This is shown in FIG. 2 as a temperature range (shown shaded) somewhat above $T_{min}$. At average temperatures, the curve of total power falls below the base. As a result, at temperatures above the intersection point of the two curves, starting occurs exclusively from the energy stored in the short-term energy storage device, and the battery does not contribute to the starting process. In other circumstances (not shown in FIG. 2), the maximum power available from the short-term energy device can fall short of the required total power at $T_{max}$, so that the battery must then contribute energy to the starting process. In other variants (not shown), the maximum short-term accumulator power can lie below the required total power at all temperatures, so that the battery contributes to starting in all circumstances.

An apparatus constructed in accordance with the teachings of the invention is shown in FIG. 3 in a preferred environment of use, namely, with an internal combustion engine 1 in a vehicle such as a passenger car. The internal combustion engine 1 releases torque to the drive wheels of the vehicle via a driveshaft 2 (for example, the crankshaft of the internal combustion engine 1), a clutch 3 and additional parts of the drive train (not shown). During the starting operation of interest here, the clutch 3 is open.

An electric machine 4 serving as a starter sits on the driveshaft 2. In the illustrated example, the electric machine 4 is implemented by an asynchronous three-phase machine. It has a rotor 5 sitting directly on, and connected to rotate in unison with the driveshaft 2. It also has a stator 6 which is supported on the housing of the internal combustion engine 1. The starter 4 (and the devices described further below for supplying the starter 4 with energy and for energy storage) are dimensioned so that the internal combustion engine 1 can preferably be started directly (i.e., without a flywheel function or the like). Preferably, no gearing-up or gearing-down is arranged between the starter 4 and the internal combustion engine 1, so that those components can permanently mate.

The winding (not shown) of the stator 6 is fed electrical currents and voltages of almost freely adjustable amplitude, phase and frequency by an inverter 7. The inverter 7 is preferably a DC-intermediate circuit-inverter, which cuts out sinusoidal width-modulated pulses from a substantially constant direct current present in an intermediate circuit 7*b* by means of electronic switches. When averaged by the inductance of the electric machine 4, the width-modulated pulses lead to almost sinusoidal currents of the desired frequency, amplitude and phase. The inverter 7 comprises a DC-AC converter 7*a* on the machine side, the intermediate circuit 7*b*, and a DC—DC voltage converter 7*c* on the electrical system side. A short-term energy storage device or accumulator 8, (for example, a capacitor) is electrically connected in the intermediate circuit 7*b*. The DC—DC converter 7*c* is coupled to a vehicle electrical system 9 and to a long-term energy storage device or accumulator, (in this example, vehicle battery 10). The electrical system 9 and the battery 10 lie at a low voltage level, (for example, 12 or 24 volts). The intermediate circuit 7*b*, on the other hand, lies at an increased voltage, which preferably advantageously lies in the range between 48 and 350 volts.

The electrical machine 4 can function as a generator (i.e., it can deliver electrical power) after the starting process is completed. To act as a starter, the electric machine 4 must be provided with electrical power. When it acts as a generator, the electric machine 4 produces power. The DC—DC converter 7*c* is, therefore, designed as a bidirectional converter, in order to be able, on the one hand, to bring electrical power from the vehicle battery 10 into the intermediate circuit 7*b* for the starting process or for preparing for the starting process and, on the other hand, to transfer energy from the intermediate circuit 7*b* to the low voltage side during generator operation in order to supply consumers of the electrical system 9 with power and to charge the vehicle battery 10. In starter or motor operation, the frequency converter 7*a* converts the direct current of the intermediate circuit 7*b* into alternating current and, in generator operation, it rectifies the energy developed by electric machine 4 and supplies it to the intermediate circuit 7*b*.

As shown in FIG. 3, the capacitor 8 is located in a position to deliver voltage pulses with a high pulse frequency (advantageously in a range from 20 kHz to 100 kHz) with the required flank steepness. It also serves as a storage for the energy required for starting, optionally in cooperation with the vehicle battery 10. (In other variants (not shown), a separate, rapidly dischargeable capacitor is provided for preparation of pulses with a steep flank. Such a second capacitor need only have limited capacitance.) The capacitor 8 can be charged either by the electric machine 4 via the frequency converter 7*a* during the generator operation, or from the battery 10 via the DC—DC converter 7*c* while the vehicle is shut down.

As shown in FIG. 3, a high-power consumer 11, (for example, an electric catalyst heater), is electrically coupled to the intermediate circuit 7*b* via a consumer control device 12. The high power consumer 11 is advantageously supplied at a high voltage level, (for example, at the voltage level of intermediate circuit 7*b*). When supplied at the intermediate circuit voltage level, the consumer control device 12 does not function as a voltage converter, but only as a current control device. In other variants, the consumer control device 12 is implemented by a voltage converter which converts the supplied voltage to higher or lower voltages.

A higher level control device or power flow controller 13 is in communication with and controls the inverter 7 (i.e., the frequency converter 7*a* and the DC—DC converter 7*c*), and the consumer control device 12. The power flow controller 13 issues commands to the frequency (DC-AC) converter 7*a* which stipulate the amplitude, phase and frequency of the three-phase current to be delivered to the starter 4. The power flow controller 13 also issues command signals to the DC—DC converter 7*c* which stipulate the amount of current, the current direction and the amount of voltage increase or reduction the DC—DC converter 7*c* is to produce. Finally, the power flow controller 13 issues commands to the consumer control device 12 which stipulate the amount of current the consumer control device 12 is to draw from the intermediate circuit 7*b* and, optionally, which voltage difference is to be produced.

The power flow control device 13 receives input signals from a temperature sensor 14. These input signals include information concerning the coolant temperature of the internal combustion engine 1. The power flow controller 13 also receives input signals from a rotation angle sensor (not shown), from which it can determine the instantaneous speed of the driveshaft 2. The power flow controller 13 may also receive a series of additional information signals concerning, for example, the position of the throttle valve of the internal combustion engine 1, the ignition point, etc.

Figure 4:
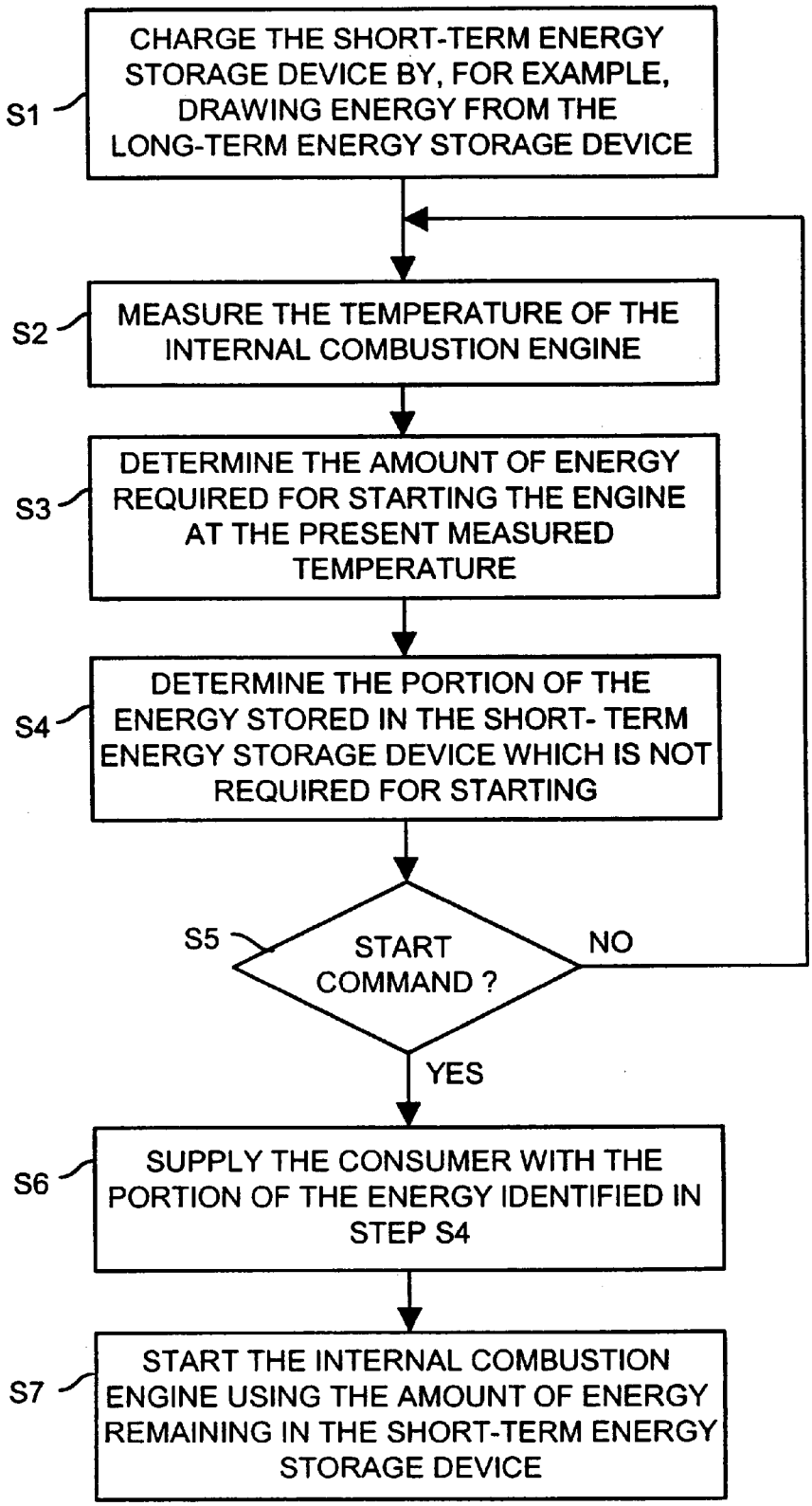
FIG. 4 is a flowchart representing exemplary steps performed by the apparatus of FIG. 3 to supply a consumer other than (and in addition to) the starter with energy during the starting process of an internal combustion engine.

Operation of the apparatus of FIG. 3 in accordance with the first aspect of the invention is explained below with reference to the flowchart of FIG. 4. In step S1 the capacitor 8 is charged to a fixed stipulated (i.e., predefined) value. This value is preferably stipulated by the reference value of the intermediate circuit voltage. If possible, the capacitor 8 is charged by the electric machine 4 (functioning as a generator) with the internal combustion engine 1 already running. During longer periods of vehicle shutdown, the capacitor 8 is gradually discharged, so that it must then be fully or partially charged by removal of energy from the vehicle battery 10.

In step S2, the control device 13 determines the instantaneous temperature of the internal combustion engine 1 with reference to the measurement information furnished by the temperature sensor 14. In step S3, the power flow control device 13 references a stored map (e.g., a family of curves or a table in memory) to determine the amount of energy that is expected to be required for starting the engine 1 at the temperature determined in the preceding step. Based on the determined required amount of energy and the known value of the amount of energy stored in the capacitor 8 (i.e., the short-term energy storage device), the power flow controller 13 determines the amount of energy stored in the capacitor 8 which is not required for starting at the present temperature (step S4).

In step S5, the power flow control device 13 determines whether a command to start the internal combustion engine 1 (say, by activation of the ignition key) has been given. If not, the power flow control device 13 repeatedly executes steps S2 to S5. On the other hand, if a start command has been given, the power flow controller 13 proceeds to the following step S6. (In other variants (not shown), the program executed by the power flow controller 13 has a passive waiting state, such that the power flow controller 13 only executes steps S2 and S4 after a start command is received.)

In any event, at step S6 the power flow control device 13 causes the consumer control device to briefly supply the high power consumer 11, (here a catalyst heater), with the excess energy stored in the capacitor 8 (i.e., the energy not required to start the engine). The catalyst heater responds by almost immediately entering the operating temperature such that it is prepared to convert harmful exhausts at the first ignitions of the engine 1. In step S7, the internal combustion engine 1 is started by delivering the energy remaining in the capacitor 8 to the starter 4 via the AC—AC converter 7*a*.

Figure 5:
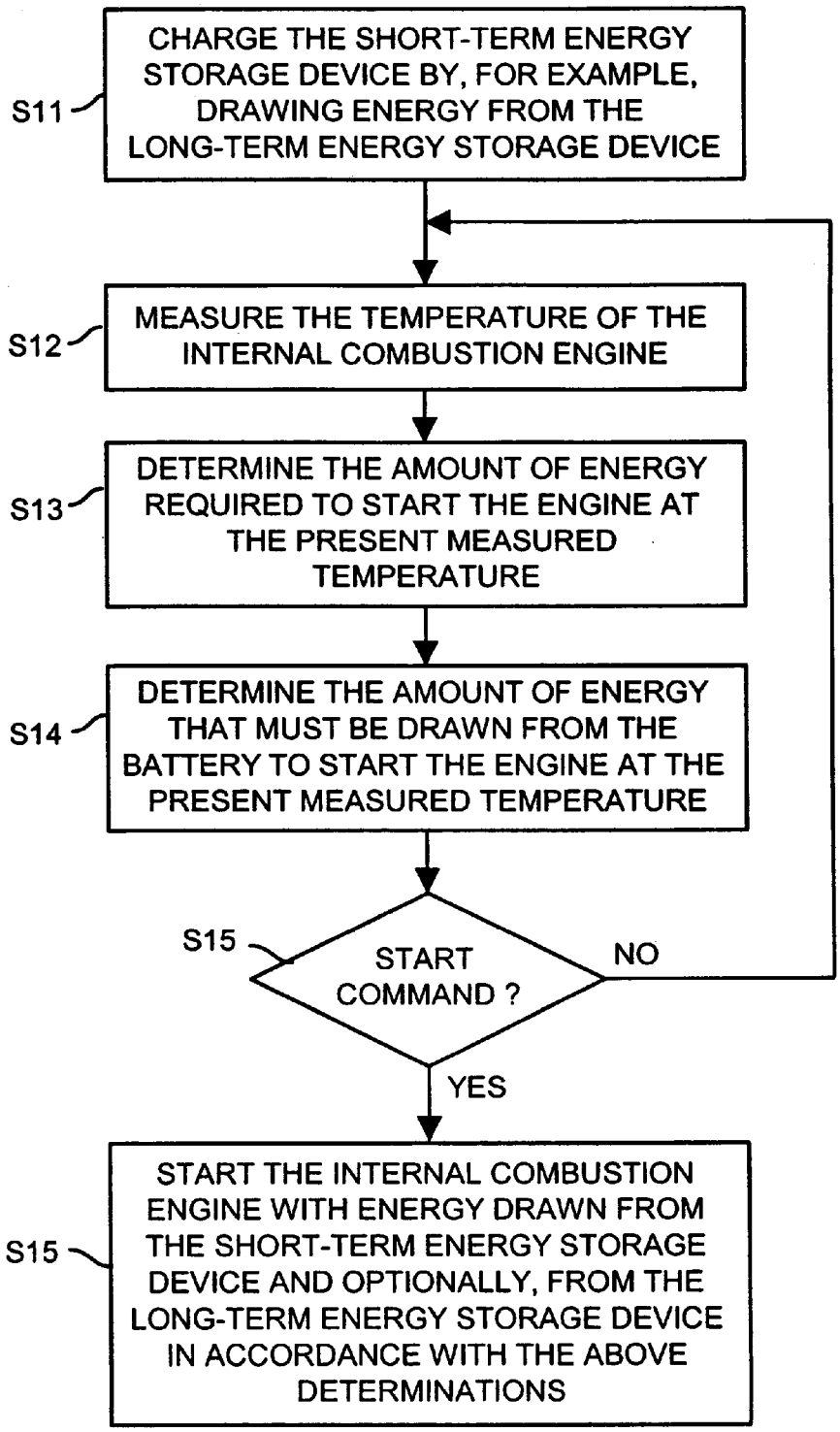
FIG. 5 is a flowchart representing exemplary steps performed by the apparatus of FIG. 3 to simultaneously supply the starter with energy from a short-term accumulator and a long-term accumulator during the starting process.

Operation of the apparatus of FIG. 3 in accordance with the second aspect of the invention is explained below with reference to the flowchart of FIG. 5, steps S11, S12 and S13 are identical to steps S1, S2 and S3. Thus, in the interest of brevity, the description of those steps will not be repeated here.

In step S14, based on the result in step S13 (i.e., the determination of the amount of energy required for stating at the present temperature), and based on the known value of the amount of energy stored in the capacitor 8, the power flow controller 13 determines the amount of energy that must be supplied by the vehicle battery 10 to start the engine 1 at the present temperature. Step S15 is identical to step S5 described above. Thus, in step S5, the power flow controller 13 determines if a start command has been given. (As with the program described in connection with FIG. 4, the start command query can occur before execution of steps S12, S13 and S14 without departing from the scope or spirit of the invention.) In step S16, the power flow control device 13 starts the internal combustion engine 1 by supplying energy from the capacitor 8 and, optionally, from the vehicle battery 10 to the starter 4. The ratio of the energy delivered from the capacitor 8 to the energy delivered by the vehicle battery 10 is in accordance with the value determined in step S14.

Persons of ordinary skill in the art will readily appreciate that steps S14 and S16 can be frequently repeated during the starting process in order to consider any time-related change in the ratio of energy to be drawn from the capacitor 8 and the battery 10 during the starting process without departing from the scope or spirit of the invention. Such a time dependence can occur, for example if, the capacitor 8 was partially discharged during the charging process and, thus, toward the end of the discharge process, can only still deliver a limited amount of energy, so that the amount of energy drawn from the vehicle battery 10 must be increased. In this variant, the percentage of the starting energy (or power) that must be drawn from the vehicle battery 10 at the present temperature is precisely determined in step S14 as a function of time relative to the starting process. In step S16, the amount of power drawn from the capacitor 8 and the battery 10 is adjusted as a function of time according to the determination made in step 14.

From the foregoing, persons of ordinary skill in the art will readily appreciate that the disclosed apparatus consider the temperature dependence of the amount of energy required to start the engine 1 during the discharge and/or starting process and deliver excess energy from the starting capacitor 8 to consumer(s) of power and/or supplement the energy supplied by the capacitor 8 with energy from the vehicle battery 10. This approach is particularly advantageous for those starter systems in which the short-term capacitor must lie at a stipulated voltage level, (e.g., the level of the intermediate circuit 7*b* of an inverter 7 that serves to supply the starter 4.

In some embodiments wherein the capacitor stores excess energy to supply one or more consumer(s), the supplied consumer(s) advantageously involve electrical heating. More specifically, to meet future strict exhaust provisions, it will presumably be necessary to electrically heat the exhaust catalysts in spark-ignition engines, even before starting the internal combustion engine 1. To address such situations, one of the consumer(s) (or optionally the only consumer) supplied with the excess energy from the short-term energy storage device 8 is preferably a catalyst heater. Since, by virtue of the arrangement discussed above in connection with FIGS. 3 and 4, the catalyst heater is supplied with high energy from the capacitor 8 immediately before starting of the engine 1, the catalyst is already heated to its operating temperature when the engine 1 starts and, thus, functions effectively from the very first ignitions of the engine 1.

In other words, the disclosed apparatus permits rapid preheating of the catalyst, almost without additional design expenditure, in which the (otherwise overdimensioned) short-term energy storage device 8 serves as an intermediate accumulator for the catalyst heating energy at all but unduly low temperatures of the internal combustion engine 1. Unlike supply from an ordinary long-term battery (which typically has a minimal discharge time greater than 30 minutes), the short-term energy storage device 8 is slowly charged and almost abruptly discharged to heat the catalyst. (The capacitor 8 is charged with limited power drawn from the battery or (during an earlier driving cycle) from the electrical machine 4.) Therefore, in contrast to an ordinary lead-acid battery, in the disclosed arrangement heating occurs with high electrical power and, thus, very quickly, (perhaps within one or a few seconds). Other heaters, for example, window heaters, can also be advantageously supplied with higher power from the capacitor 8 before starting in the same manner as the catalyst heater without departing from the scope or spirit of the invention.

Advantageously, in some embodiments which supply energy to start the engine 1 from both the capacitor 8 and the vehicle battery 10, only as much power is taken from the longterm battery 10 as is required for starting with full utilization of the energy stored in the short-term energy storage device 8. This approach advantageously leads to minimal short-term loading of the long-term energy storage device 10. As explained above, the power required for starting depends strongly on the temperature of the internal combustion engine 1. The amount of power drawn from the long-term energy storage device 10 can, therefore, be controlled based on measurement of the instantaneous temperature value of the engine with reference to a known temperature dependence function.

In another advantageous embodiment, only as much power is drawn from the short-term accumulator 8 as is required to start the engine with full utilization of the energy available from the long-term accumulator 10. This approach to the second aspect of the invention permits use of the maximum possible amount of energy stored in the short-term accumulator 8 at the corresponding temperature for purposes other than starting the engine 1 in accordance with the first aspect of the invention. For example, it maximizes the amount of energy that the capacitor 8 can supply to other consumer(s) (e.g., a catalyst heater) before starting the engine.

In embodiments that limit the amount of power the capacitor 8 supplies for starting such as those discussed in the immediately preceding paragraph, the greatest possible power is advantageously taken from the long-term battery 10. This is achieved by using the coupling circuit 7*c* to load the long-term battery 10 with optimal adjustment, (i.e., the effective internal resistance of the coupling circuit 7*c* is roughly equal to the internal resistance of the long-term battery 10). In this adjustment, resistances between the long-term battery 10 and the coupling circuit 7*c* are considered in which they are added either to the input resistance of the coupling circuit 7*c* or the internal resistance of the long-term battery 10). Such embodiments assign the long-term battery 10 a comparatively greater percentage of total power and, therefore, permit comparatively maller dimensioning of the short-term energy storage device 8. In modifications of this embodiment, only a certain fraction of the greatest possible power is taken from the long-term battery 10, (for example, fractions in the range from 50 to 100%, advantageously 65 to 100%, but preferably 75 to 100%, and even more preferably 90 to 100% of the greatest possible power).

As mentioned above, the short-term energy storage device 8 preferably operates on a different, (preferably a higher) voltage level than the long-term battery 10. Therefore, the coupling circuit 7*c* preferably includes a voltage converter, (e.g., a high positioner), which functions to adjust energy from one voltage level to the other and vice versa. The different voltage levels can be advantageously adapted to the different technical properties of the two different types of energy storage devices 8, 10. For example, a capacitor generally reaches its greatest energy accumulation density at a relatively high voltage level (for example, at 300 volts), whereas a storage battery, (depending on the employed type of battery and the number of cells connected in series), generally delivers lower voltages, which typically correspond to the voltage of a low-voltage electrical system (for example, 12 volts or 24 volts).

Figure 6:
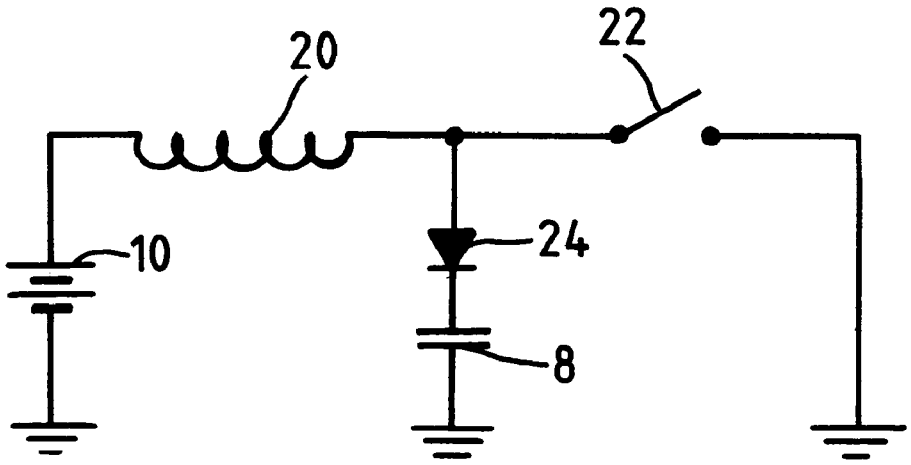
FIG. 6 is a schematic illustration of an exemplary induction pump circuit which may optionally be employed in the DC—DC converter of FIG. 3.

The coupling circuit 7*c* is preferably implemented by a DC—DC voltage converter based on an induction pump circuit. A schematic illustration of an exemplary induction pump circuit is shown in FIG. 6. This induction pump circuit is constructed, for example, from a series circuit of an inductor 20 and an electronic switch 22 (e.g., a transistor or SCR), which carries current from the long-term energy storage device 10 when the switch is closed. A circuit branch to the short-term energy storage device 8 (which lies at the higher voltage level) is situated between these two elements. This circuit branch includes a diode 24 that prevents backflow from the short term energy storage device 8. By rapidly opening and closing the switch 22, a voltage peak (in principle, of any level) is formed by induction, which allows current to flow briefly at the high voltage level and, therefore, raises the voltage across the inductor 20. By increasing or reducing the switching frequency of the switch 22, the voltage across the inductor 20 and, thus, the amount of current delivered to the capacitor 8 can be correspondingly increased or reduced.

As mentioned above, the starter 4 is advantageously fed from an inverter 7 with a DC intermediate circuit 7*b*. The short-term energy storage device 8 preferably lies at the voltage level of the DC intermediate circuit 7*b*. As also mentioned above, a DC-AC inverter 7*a* cuts out width-modulated pulses from a constant intermediate circuit voltage by means of electronic switches (for example, field effect transistors or IGBT's). When averaged by the inductance of the generator 4, these pulses lead to almost sinusoidal alternating currents of the desired frequency, amplitude and phase. (In the opposite direction, the AC-DC converter 7*a* produces almost smooth direct currents at the desired (intermediate circuit) voltage.) The starter 4 is, therefore, particularly advantageously designed as a three-phase machine (also called a rotating field machine). This is understood to mean, in contrast to a commutator machine, a commutatorless machine in which the stator 6 generates a rotating magnetic field, which encompasses 360° and entrains the rotor 5.

The starter 4 can be designed, in particular as an asynchronous machine, (for example, with a short-circuit rotor), or as a synchronous machine, (for example, with a rotor with salient magnetic poles). The shortcircuit rotor in the asynchronous machine can be a squirrel cage rotor with short-circuit rods in the axial direction. In other embodiments of the asynchronous machine, the rotor 5 has windings that can be externally shorted via slip rings. The salient magnetic poles of the rotor 5 in the synchronous machine are implemented by permanent magnets or by electromagnets, which can be fed with exciter current via slip rings. The starter 4 can be coupled to the driveshaft 2 of the internal combustion engine 1 indirectly, (for example, via pinions, gears, etc.). However, preferably the rotor 5 of the starter 4 sits directly on the engine shaft 2 and is preferably coupled or can be coupled to rotate in unison with the shaft 2. The rotor 5, can sit on the shaft 2 leading to the transmission, or on the other side of the internal combustion engine 1 on the shaft stub that ends blindly there. The stator 6 is fixed or releasably connected to a non-rotatable part, for example, to the engine or transmission housing.

In addition to the starter function, an inverter-controlled three-phase machine 4 can advantageously have one or more additional functions. For example, the electric machine 4 can function as a generator for supplying the electrical system 9, as an additional vehicle drive engine, as an additional drive brake, and/or as an active smoothing device for torque irregularities that occur in internal combustion engines because of their discontinuous method of operation. Conversion from motor to generator operation occurs by corresponding conversion of the magnetic fields by reversing (or reducing or increasing) the current through the inverter 7.

Although certain embodiments of the teachings of the invention have been described herein, the scope of coverage of this patent is not limited thereto. On the contrary, this patent covers al instantiations of the teachings of the invention fairly falling within the scope of the appended claims either literally or under the doctrine of equivalents.

What is claimed is:

1. For use with an internal combustion engine and a consumer of electrical power, an apparatus comprising:

an electric starter operatively coupled to the internal combustion engine;

a short-term energy storage device in circuit with the starter and storing energy for supplying the starter with power;

a sensor for detecting a temperature of the internal combustion engine; and a power flow controller in communication with the sensor, the power flow controller controlling power flow from the short-term energy storage device to the consumer such that a portion of the energy stored in the short-term energy storage device is delivered to the consumer of electrical power before the electric starter is supplied with power, the portion of the energy having a size which is dependent upon the sensed temperature, the size of the portion being smaller at low temperatures than at high temperatures.

2. An apparatus as defined in claim 1 wherein the consumer of electrical power comprises an electrical heater.

3. An apparatus as defined in claim 2 wherein the electrical heater comprises a catalyst heater.

4. An apparatus as defined in claim 1 wherein the short-term energy storage device comprises a capacitor.

5. An apparatus as defined in claim 1 further comprising an inverter in circuit with the electric starter for supplying energy thereto, the inverter having a DC intermediate circuit, the short-term energy storage device being located in the DC intermediate circuit.

6. An apparatus as defined in claim 1 further comprising a consumer control device associated with the consumer of electrical power and in circuit with the short-term energy storage device, the power flow controller controlling the consumer control device to deliver the portion of energy to the consumer at start-up, but before the electric starter is supplied with power.

7. For use with an internal combustion engine, an apparatus comprising:

an electric starter operatively coupled to the internal combustion engine;

a short-term energy storage device in circuit with the starter and storing energy for supplying the starter with power;

a long-term energy storage device;

a sensor for detecting a temperature of the internal combustion engine;

a coupling circuit separating the short-term energy storage device from the long-term energy storage device, the coupling circuit being arranged to permit simultaneous withdrawal of energy from the short-term energy storage device and the long-term energy storage device for delivery to the electric starter during a starting operation, wherein the coupling circuit includes a voltage converter, the short-term energy storage device is maintained at a first voltage level, and the long-term energy storage device is maintained at a second voltage level, the first voltage level being different than the second voltage level; and a power flow controller in communication with the sensor and the coupling circuit to actively control an amount of at least one of energy and power withdrawn from at least one of the short-term energy storage device and the long-term energy storage device based on the sensed temperature to ensure at least one of sufficient energy and sufficient power is supplied to the electric starter to start the internal combustion engine.

8. An apparatus as defined in claim 7 wherein a maximum amount of at least one of energy and power is withdrawn from the short-term energy storage device and the power flow controller controls the coupling circuit to only withdraw an amount of at least one of energy and power from the long-term energy storage device required to supplement the at least one of energy and power withdrawn from the short-term energy storage device to a level at least sufficient to start the internal combustion engine.

9. An apparatus as defined in claim 7 wherein the power flow controller controls the coupling circuit to withdraw a maximum amount of at least one of energy and power from the long-term energy storage device, and only an amount of at least one of energy and power required to supplement the at least one of energy and power withdrawn from the long-term energy storage device to a level at least sufficient to start the internal combustion engine is withdrawn from the short-term energy storage device.

10. An apparatus as defined in claim 7 wherein the power flow controller controls the coupling circuit to withdraw at least one of (a) a maximum amount of at least one of energy and power available from the long-term energy storage device and (b) a predefined fraction of the maximum amount of at least one of energy and power available from the long-term energy storage device.

11. An apparatus as defined in claim 7 wherein the first voltage level is higher than the second voltage level.

12. An apparatus as defined in claim 7 further comprising an inverter in circuit with the electric starter for supplying energy thereto, the inverter having a dc intermediate circuit, the short-term energy storage device being located in the dc intermediate circuit.

13. An apparatus as defined in claim 7 wherein the short-term energy storage device comprises a capacitor and the long-term energy storage device comprises a vehicle battery.

14. A method for starting an internal combustion engine comprising the steps of:

charging a short-term energy storage device;

measuring a temperature;

determining a first amount of energy required to start the internal combustion engine at the measured temperature;

determining if the short-term energy device contains more than the first amount of energy;

if the short-term energy device contains more than the first amount of energy, responding to a command to start the internal combustion engine by delivering a second amount of energy from the short-term energy storage device to at least one consumer of electrical power; and starting the internal combustion engine using the energy remaining in the short-term energy storage device.

15. A method as defined in claim 14 wherein the step of charging the short-term energy storage device is performed with energy from a longterm energy storage device.

16. A method as defined in claim 15 wherein the short-term energy storage device comprises a capacitor and the long-term energy storage device comprises a battery.

17. A method as defined in claim 14 wherein the step of measuring a temperature comprises measuring a temperature associated with the internal combustion engine.

18. A method as defined in claim 17 wherein the step of measuring a temperature comprises measuring an ambient temperature.

19. For use with an internal combustion engine, an apparatus comprising:

an electric starter operatively coupled to the internal combustion engine;

a short-term energy storage device in circuit with the starter and storing energy for supplying the starter with power;

a long-term energy storage device;

a sensor for detecting a temperature of the internal combustion engine;

a coupling circuit separating the short-term energy storage device from the long-term energy storage device, the coupling circuit being arranged to permit simultaneous withdrawal of energy from the short-term energy storage device and the long-term energy storage device for delivery to the electric starter during a starting operation;

an inverter in circuit with the electric starter for supplying energy thereto, the inverter having a dc intermediate circuit, the short-term energy storage device being located in the dc intermediate circuit; and a power flow controller in communication with the sensor and the coupling circuit to actively control an amount of at least one of energy and power withdrawn from at least one of the short-term energy storage device and the long-term energy storage device based on the sensed temperature to ensure at least one of sufficient energy and sufficient power is supplied to the electric starter to start the internal combustion engine.

20. An apparatus as defined in claim 19 wherein a maximum amount of at least one of energy and power is withdrawn from the short-term energy storage device and the power flow controller controls the coupling circuit to only withdraw an amount of at least one of energy and power from the long-term energy storage device required to supplement the at least one of energy and power withdrawn from the short-term energy storage device to a level at least sufficient to start the internal combustion engine.

21. An apparatus as defined in claim 19 wherein the power flow controller controls the coupling circuit to withdraw a maximum amount of at least one of energy and power from the long-term energy storage device, and only an amount of at least one of energy and power required to supplement the at least one of energy and power withdrawn from the long-term energy storage device to a level at least sufficient to start the internal combustion engine is withdrawn from the short-term energy storage device.

22. An apparatus as defined in claim 19 wherein the power flow controller controls the coupling circuit to withdraw at least one of (a) a maximum amount of at least one of energy and power available from the longterm energy storage device and (b) a predefined fraction of the maximum amount of at least one of energy and power available from the long-term energy storage device.

23. An apparatus as defined in claim 19 wherein the short-term energy storage device comprises a capacitor and the long-term energy storage device comprises a vehicle battery.

24. An apparatus as defined in claim 12 wherein the first voltage level is higher than the second voltage level.

25. For use with an internal combustion engine, an apparatus comprising:

an electric starter operatively coupled to the internal combustion engine;

a short-term energy storage device in circuit with the starter and storing energy fir supplying the starter with power;

a long-term energy storage device;

a coupling circuit separating the short-term energy storage device from the long-term energy storage device, the coupling circuit being arranged to permit simultaneous withdrawal of energy from the short-term energy storage device and the long-term energy storage device for delivery to the electric starter during a starting operation; and a power flow controller in communication with the coupling circuit to continuously actively adjust a ratio of at least one of energy and power withdrawn from the short-term energy storage device versus at least one of energy and power withdrawn from the long-term energy storage device to ensure sufficient energy is supplied to the electric starter to start the internal combustion engine.

26. An apparatus as defined in claim 25 wherein a maximum amount of at least one of energy and power is withdrawn from the short-term energy storage device and the power flow controller controls the coupling circuit to only withdraw an amount of at least one of energy and power from the long-term energy storage device required to supplement the at least one of energy and power withdrawn from the short-term energy storage device to a level at least sufficient to start the internal combustion engine.

27. An apparatus as defined in claim 25 wherein the power flow controller controls the coupling circuit to withdraw a maximum amount of at least one of energy and power from the long-term energy storage device, and only an amount of at least one of energy and power required to supplement the at least one of energy and power withdrawn from the long-term energy storage device to a level at least sufficient to start the internal combustion engine is withdrawn from the short-term energy storage device.

28. An apparatus as defined in claim 25 wherein the power flow controller controls the coupling circuit to withdraw at least one of (a) a maximum amount of at least one of energy and power available from the longterm energy storage device and (b) a predefined fraction of the maximum amount of at least one of energy and power available from the long-term energy storage device.

29. An apparatus as defined in claim 25 wherein the short-term energy storage device comprises a capacitor and the long-term energy storage device comprises a vehicle battery.

* * * * *